US006209784B1

(12) United States Patent
Jensen

(10) Patent No.: US 6,209,784 B1
(45) Date of Patent: Apr. 3, 2001

(54) LOCKING SANDWICH COLLAR

(76) Inventor: Kurt Jensen, 189 Summit St., Lebanon, OH (US) 45036

( * ) Notice: Subject to any disclaimer, the term of this patent is extended or adjusted under 35 U.S.C. 154(b) by 0 days.

(21) Appl. No.: 09/192,607

(22) Filed: Nov. 16, 1998

(51) Int. Cl.[7] ..... B65D 67/00

(52) U.S. Cl. ..... 229/199; 229/87.08; 229/938; 493/287; 493/296; 493/309

(58) Field of Search ..... 229/87.02, 87.08, 229/199, 938; 426/124; 493/287, 296, 309, 405, 356; 217/3 FC

(56) References Cited

U.S. PATENT DOCUMENTS 1,593,302 * 7/1926 Hiatt ..... 217/3 FC
1,991,746 * 2/1935 Hiatt ..... 217/3 FC
2,632,563 * 3/1953 MacIntyre ..... 229/87.08
2,750,294 * 6/1956 Peters ..... 426/124
3,382,779 * 5/1968 Lynas ..... 493/287
3,964,669 * 6/1976 Sontag et al. ..... 229/87.08
4,573,570 * 3/1986 Cortopassi ..... 229/938
4,586,649 * 5/1986 Webinger ..... 426/124
4,595,137 * 6/1986 Kupersmit ..... 229/199

* cited by examiner

*Primary Examiner*—Gary E. Elkins
(74) *Attorney, Agent, or Firm*—Ralph J. Skinkiss

(57) ABSTRACT

The present invention discloses an improved, cylindrical, paperboard collar for placing around a specialty sandwich such as a multilayer hamburger or such. The collar blank is cut from flat paperboard stock in the form of an elongated rectangle which is folded back over itself having its free ends adhesively attached to one another whereby the resulting flat preform may be expandingly opened to form a cylindrical configuration. Two tongue like locking tabs are cut into the paperboard surface which when the preform is expanded to form an upright cylinder the tabs act to maintain the open cylinder.

5 Claims, 2 Drawing Sheets

FIG. 4
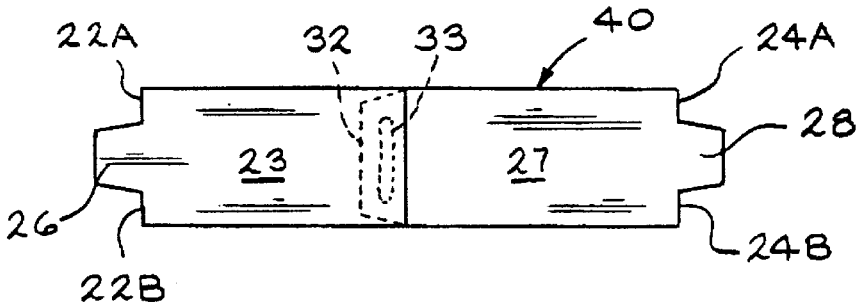
FIG. 5
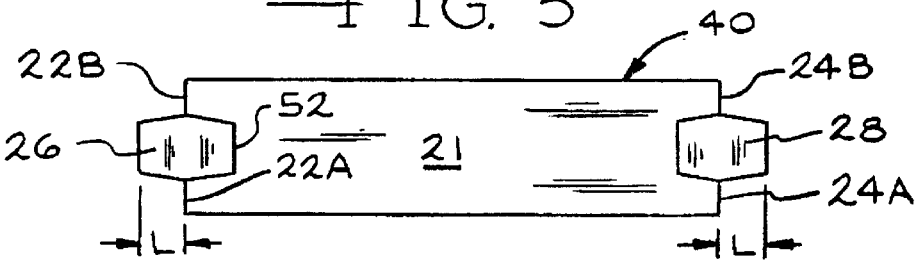
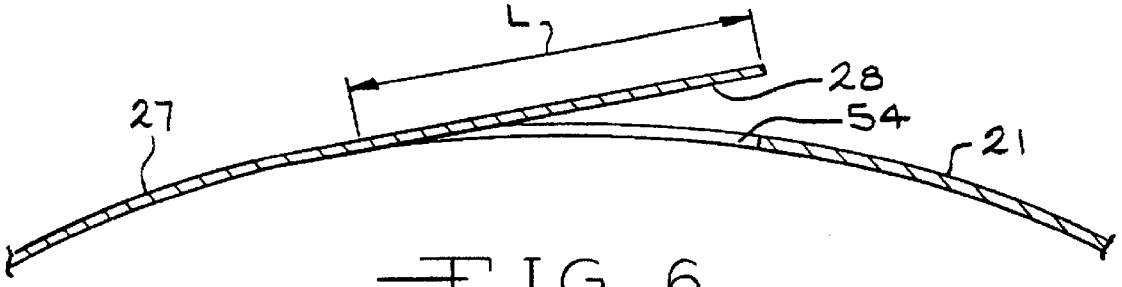
FIG. 6
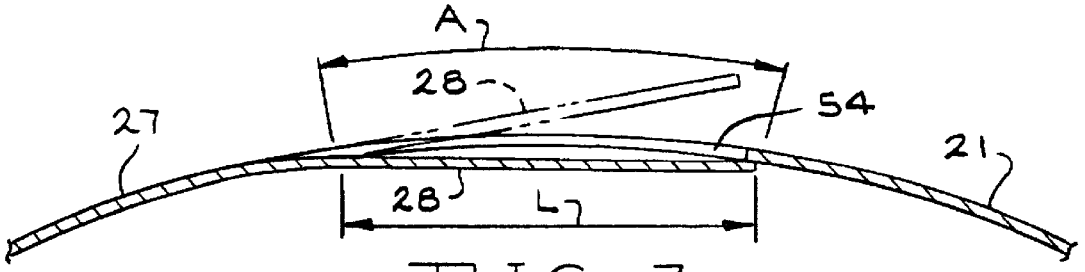
FIG. 7

LOCKING SANDWICH COLLAR

BACKGROUND OF THE INVENTION

The present invention relates to an improved cylindrical collar as typically used in the fast food industry for placing around specialty sandwiches, such as a multilayered hamburger or such, thereby maintaining the lateral alignment of the sandwich bun halves, meat patty, and selected toppings when wrapped in a paper sandwich wrap or placed in a clamshell container. Also the collar quickens the building of a sandwich as the collar as serves an external form when the sandwich is assembled within the collar.

BRIEF SUMMARY OF THE INVENTION

Disclosed herein is an improved, cylindrical, paperboard, fast food, sandwich collar for placing around a specialty sandwich such as a multilayer hamburger or such. The collar blank is cut from flat paperboard stock in the form of an elongated rectangle which is folded back over itself having its free ends adhesively attached to one another whereby the resulting flat preform, suitable for shipping, may be expandingly opened to form a cylindrical configuration. Diametrically opposing tongue like tabs are cut into the paperboard surface. Each tab is cut on three sides thereby being hingedly connected to the collar by its uncut side.

When the flat preform is expanded into its cylindrical shape the tabs act as cantilever springs upon the inside surface of the collar thereby maintaining the open cylindrical shape for inserting therein a specialty food product.

Although the collar, as disclosed herein is directed to the fast food industry it is to be understood that the invention disclosed and taught may be used for a variety of end uses other than a sandwich wrap in the fast food industry. For example, the collar may be used as a spacer within a shipping container to encircle and protect damageable products during shipping. Further the collar taught herein may be used as a temporary arm band to identify persons of authority or of a select group. Still further the collar may be given a crown like configuration and used by children or issued as a promotional tool for advertising. Other end uses will surely come to mind by imaginable persons.

Because of the wide range of possible uses for my collapsible collar the end use thereof is not to be construed as applicable solely to the fast food industry as a sandwich packaging device. The sandwich packaging device, as disclosed herein, was merely the catalyst for discovery of the broad invention taught and claimed below.

DESCRIPTION OF THE DRAWINGS

FIG. 4 presents a top plan view of the blank as shown in FIG. 3 after the second fold is made and represents the non-erected preform of the band as illustrated in FIG. 1.

FIG. 5 presents the bottom view of the band preform as shown in FIG. 4.

FIG. 6 presents a sectional view taken along line 6—6 illustrating the general position of the locking tab prior to being snapped into locking engagement.

FIG. 7 presents a sectional view taken along line 7—7 illustrating the general position of the locking tab after it is snapped into locking engagement.

DETAILED DESCRIPTION OF THE PREFERRED EMBODIMENT

Figure 1:
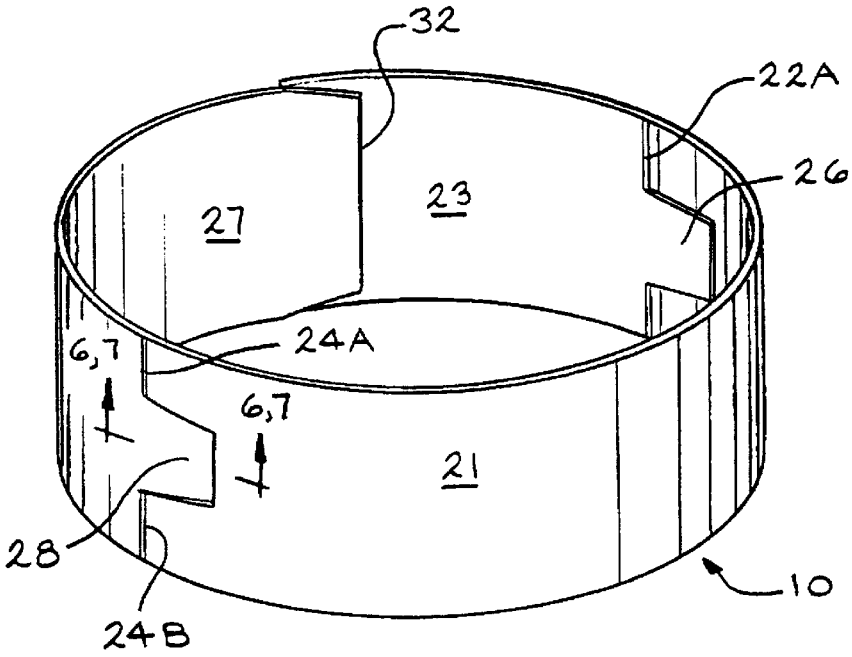
FIG. 1 presents a pictorial view of my improved band in its erected configuration ready for use.

FIG. 1 presents a pictorial view of my improved band 10 in its open functional configuration useful for placing around the periphery of a bun type specialty sandwich, not shown, such as a hamburger, barbecue, or other suitable food products.

Figure 2:
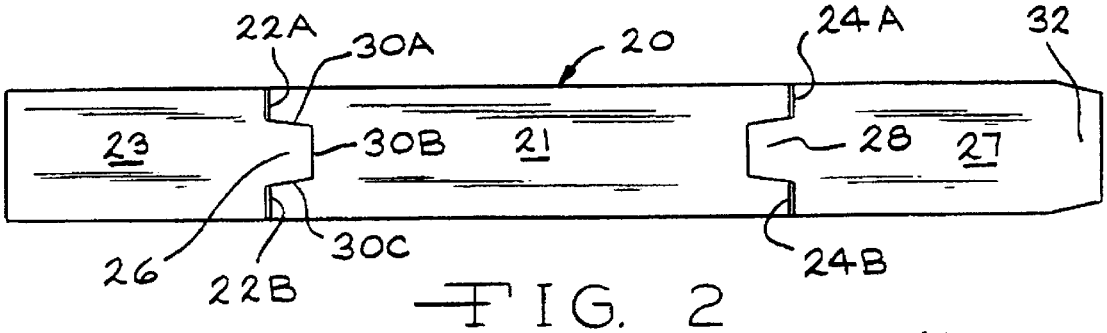
FIG. 2 presents a plan view of the paperboard blank from which the band is formed.

Band 10 is constructed from an elongated, rectangular, paperboard blank 20 illustrated in FIG. 2. Blank 20 comprises three primary sections, a center section 21, and two end sections 23 and 27. Separating center section 21 and end section 23 are two score lines 22A and 22B extending from and generally perpendicular to the blank's free edge as illustrated in FIG. 2. Score lines 22A and 22B extend from the peripheral edge of blank 20 inwardly for approximately one third, or less, of the blank width as shown in FIG. 2. Extending between score lines 22A and 22B is laterally extending, trapezoidal shaped tab 26 formed by cut lines 30A, 30B, and 30C Similarly to sections 21 and 23, sections 21 and 27 are separated by tab 28 and score lines 24A and 24B. Although a trapezoidal shape is preferred for tabs 26 and 28, other configurations are possible. For example cut lines 30A and 30C may be replaced by a curved cut line.

Figure 3:
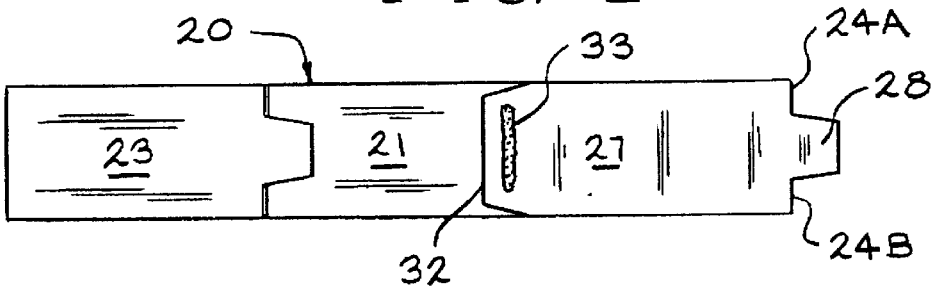
FIG. 3 presents a top plan view of the blank as shown in FIG. 2 after the first fold is made.

The preform 40 for band 10, as illustrated in FIGS. 4 and 5, is made by folding end section 27 180 degrees about score lines 24A and 24B so as to overlie a portion of center section 21, as illustrated in FIG. 3, thereby causing tab 28 to extend laterally outward from the score lines. A line of adhesive 32 is placed on the top side of tongue 32 and end section 23 is folded 180 degrees about score lines 22A and 22B so as to overlie center section 21 and end section 27 including adhesive line 32 whereby the inside of end section 23 is adhered to the outer side of end section 27 by adhesive line 32. Thus preform 40, as illustrated in FIG. 4, results. FIG. 5 illustrates the reverse side of preform 40, illustrated in FIG. 4, showing open apertures 52 and 54, and their associated, laterally extending, tabs 26 and 28 created by folding over end sections 23 and 27 as described above. Preform 40 provides a convenient configuration for shipping large quantities of my improved sandwich band.

The band 10, as illustrated in FIG. 1, is simply formed from preform 40 by expanding preform 40 into an open circular configuration whereby tabs 26 and 28 assume the configuration as illustrated in FIG. 6. Tabs 26 and 28 extend linearly outward from the curved periphery of center section 21 as illustrated in FIG. 6. Tabs 26 and 28 are then snapped inward through their associated apertures 52 and 54 assuming the position as illustrated in FIG. 7.

When tabs 26 and 28 are snapped inside the arc A of the circular band 10 the free end of the tab frictionally engages the inside surface of center section 21 as illustrated in FIG. 7. Tabs 26 and 28, once snapped inside apertures 52 and 54, will remain locked in place because the straight line length L of the tabs is equal to the arc length A of the curved band from the score lines 22 and 24 to the opposite end of the associated aperture 52 and 54 respectively is slightly longer than the actual chord length of arc A. Thus tabs 26 and 28 act as cantilever beams thereby supporting the load placed upon the tab (beam) end by center section 21 thereby maintaining the free standing circular shape of band 10.

While there has been described hereinabove a preferred embodiment of the invention, variations and modifications and other end uses thereof will occur to those skilled in the art once they become acquainted with the basic concepts of the invention. Therefore, it is intended that the appended claims shall be construed to include all such variations, modifications and end uses that may fall within the true spirit and scope of the invention as clamed below.

I claim:

1. A paperboard blank suitable for forming a free standing circular collar comprising:

a) a generally flat, elongated, rectangular, paperboard, blank;

b) said blank divided into a center section, and two opposing end sections positioned on either side of said center section;

c) said center section separated from each of said end sections by a first and second score line, each of said score lines transversely aligned with one another and extending from and perpendicular to said blank's free edge;

d) a laterally extending tab positioned between said score lines and coplanar with said blank;

e) said tabs formed by cut lines extending through the thickness of said paperboard.

2. The paperboard blank as claimed in claim 1 wherein said tabs are formed by three, connected cut lines.

3. The paperboard blank as claimed in claim 2 wherein said cut lines form trapezoidal shaped tabs.

4. A method of producing a generally flat, storable, paperboard preform suitable for expanding into a cylindrical collar comprising the steps of:

a) cutting from flat planar paperboard stock a blank comprising:

1) a generally flat, elongated, rectangular, paperboard, blank;

2) said blank divided into a center section, and a first and second end section positioned on either side of said center section;

3) said center section separated from each of said end sections by a first and second score line, each of said score lines transversely aligned with one another and extending from and perpendicular to said blank's free edge;

4) a laterally extending tab positioned between said score lines and coplanar with said blank;

5) said tabs formed by three cut lines extending through the thickness of said paperboard thereby forming trapezoidal shaped tabs;

b) folding said first end section 180 degrees, about said score lines, so as to overlie said center section;

c) folding said second end section 180 degrees about said score lines so as to overlie said first end section;

d) affixing said first end section to said second end section.

5. A method of producing a generally cylindrical paperboard collar comprising the steps of:

a) cutting from flat planar paperboard stock a blank comprising:

1) a generally flat, elongated, rectangular, paperboard, blank;

2) said blank divided into a center section, and a first and second end section positioned on either side of said center section;

3) said center section separated from each of said end sections by a first and second score line, each of said score lines transversely aligned with one another and extending from and perpendicular to said blank's free edge;

4) a laterally extending tab positioned between said score lines and coplanar with said blank;

5) said tabs formed by lines extending through the thickness of said paperboard thereby forming trapezoidal shaped tabs;

b) folding said first end section 180 degrees, about said score lines, so as to overlie said center section;

c) folding said second end section 180 degrees about said score lines so as to overlie said first end section;

d) affixing said first end section to said second end section thereby forming a generally flat preform;

e) Expanding said preform to a generally cylindrical configuration and positioning said tabs inside said collar whereby said tabs engage the inside surface of said collar thereby maintaining said cylindrical shape.

* * * * *